US006171145B1

(12) United States Patent
Murayama

(10) Patent No.: US 6,171,145 B1
(45) Date of Patent: Jan. 9, 2001

(54) WATERPROOF CONNECTOR

(75) Inventor: Toshisada Murayama, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/505,661

(22) Filed: Feb. 17, 2000

(30) Foreign Application Priority Data

Feb. 22, 1999 (JP) ..... 11-043374

(51) Int. Cl.[7] ..... H01R 13/40
(52) U.S. Cl. ..... 439/587; 439/936
(58) Field of Search ..... 439/274, 275, 439/279, 587, 589, 936

(56) References Cited

U.S. PATENT DOCUMENTS 4,662,692 * 5/1987 Uken et al. ..... 439/587
5,529,508 * 6/1996 Chiotis et al. ..... 439/936
5,588,856 * 12/1996 Collins et al. ..... 439/589
6,095,859 * 8/2000 Maeda ..... 439/587

* cited by examiner

*Primary Examiner*—T. C. Patel
(74) *Attorney, Agent, or Firm*—Sughrue, Mion, Zinn, Macpeak & Seas, PLLC

(57) ABSTRACT

The waterproof connector of the present invention, a connector housing of the waterproof connector is penetrated by which a first terminal through hole is parallel to each other at one side, and is provided with a gel accommodating chamber accommodating a gel slab material at the other side. A sustain portion is penetrated by a first terminal through hole which is parallel to each other and coincide with an axial line of each first terminal through hole. A gel slab material is accommodated in said gel accommodating chamber by holding between an inner wall surface of said connector housing and an inner wall surface of said sustain portion. A first gel rubbish accommodating portion, for accommodating gel chip rubbish, formed in said inner wall side of said connector housing. A second gel rubbish accommodating portion, for accommodating gel chip rubbish, formed in said inner wall side of said sustain portion.

9 Claims, 5 Drawing Sheets

WATERPROOF CONNECTOR

BACKGROUND OF THE INVENTION

The present invention relates to a waterproof connector used for the wiring of an automobile and so on. Particularly, the present invention relates to a waterproof connector in which terminals break through an internal waterproofing gel slab to be inserted into terminal through hole.

FIG. 5 shows an example of a general waterproof connector. This waterproof connector 20 includes a connector housing 21 including terminal through holes 22 and a gel accommodating chamber 23, a sustaining portion 25 including terminal through holes 24, and a gel slab material 26 which is accommodated into the gel accommodating chamber 23 by being held between an inner wall surface 21C of the connector housing 21 and an inner wall surface 25C of the sustaining portion. A terminal 27 is inserted into and extended across the terminal through hole 22 and the terminal through hole 24.

A connector housing 21 is penetrated by two parallel terminal through holes 22 at one side 21A. The connector housing 21 is provided with the gel accommodating chamber 23 accommodating gel slab material 26 at the other side 21B. The sustaining portion 25 is penetrated by two parallel terminal through holes 24 which coincide with axial lines M of respective terminal through holes 22.

The sustaining portion 25 fits into an open end side of the gel accommodating chamber 23 so that a locking portion 29 is engaged with a projection 28. The lock portion 29 is provided at an outer peripheral portion of the sustaining portion 25. The projection 28 is provided at outer peripheral portion of connector housing 21.

Since the gel slab material 26 is sustained between the connector housing 21 and the sustaining portion 25, watertightness of waterproof connector is kept to prevent entering of water from outside.

As shown in FIG. 6(*a*), when the terminal 27 of the waterproof connector 20 is inserted into the terminal through hole 22,24 by breaking through the gel slab material 26 which is accommodated in the gel accommodating chamber 23, gel chip rubbish 46 may be formed and stay in the terminal through hole 22, the gel chip rubbish 46 causes an imperfect contact of the connector.

On the other hand, as shown in FIG. 6(*b*), when the terminal 27 is pulled because of miss insertion and so on, the gel chip rubbish 46 may be formed and stay in the terminal through hole 24. Similarly, the gel chip rubbish 46 causes an electrically imperfect contact of the connector.

SUMMARY OF THE INVENTION

The present invention was invented to solve the above-mentioned problems, and an object thereof is to provide a waterproof connector which avoids an imperfect contact associated with the gel slab material staying in the terminal through hole.

To accomplish the above-mentioned object, the present invention provides a water-proof connector which includes:

a connector housing penetrated at one side by at least one first terminal through hole, said connector housing being provided with a gel accommodating chamber;

a sustain portion penetrated by at least one second terminal through hole coaxially arranged with respect to said at least one first terminal through hole;

a gel slab material accommodated in said gel accommodating chamber and held between an inner wall surface of said connector housing and an inner wall surface of said sustain portion;

a first gel rubbish accommodating portion provided for each of said at least one first terminal though hole, located close to said inner wall surface of said connector housing, for accommodating gel chip rubbish; and a second gel rubbish accommodating portion provided for each of said at least one second terminal through hole, located close to said inner wall side of said sustain portion, for accommodating said gel chip rubbish.

For the first gel rubbish accommodating portion and the second gel rubbish accommodating portion, it is not limited in formed by space portions between each piece provided at the side of the inner wall surface of the connector housing, and use an object which includes recess grooves provided at the side of the inner wall surface of the connector housing.

In the thus constructed waterproof connector including, when the terminal is gotten into the terminal through hole with breaking through the gel slab material, as the gel chip rubbish is accommodated into the first gel rubbish accommodating portion formed at the inner peripheral wall side of the connector housing, the gel chip rubbish getting into the terminal through hole is prevented.

On the other hand, also when the terminal is pulled from the terminal through hole, as the gel chip rubbish is accommodated into the second gel rubbish accommodating portion formed at the inner peripheral wall side of the sustaining portion, the gel chip rubbish getting into the terminal through hole is prevented.

That is to say, when the terminal is inserted into the terminal through hole and when the terminal is pulled from the terminal through hole, as escape spaces are provided with to accommodate the generated gel chip rubbish, the gel chip rubbish getting into the terminal through hole is prevented. And an electrically imperfect contact, being caused by the gel chip rubbish getting into the terminal through hole, is avoided.

DETAILED DESCRIPTION OF PREFERRED EMBODIMENT

Now, a waterproof connector according to an embodiment of the present invention will be explained with reference to drawings.

Figure 5:
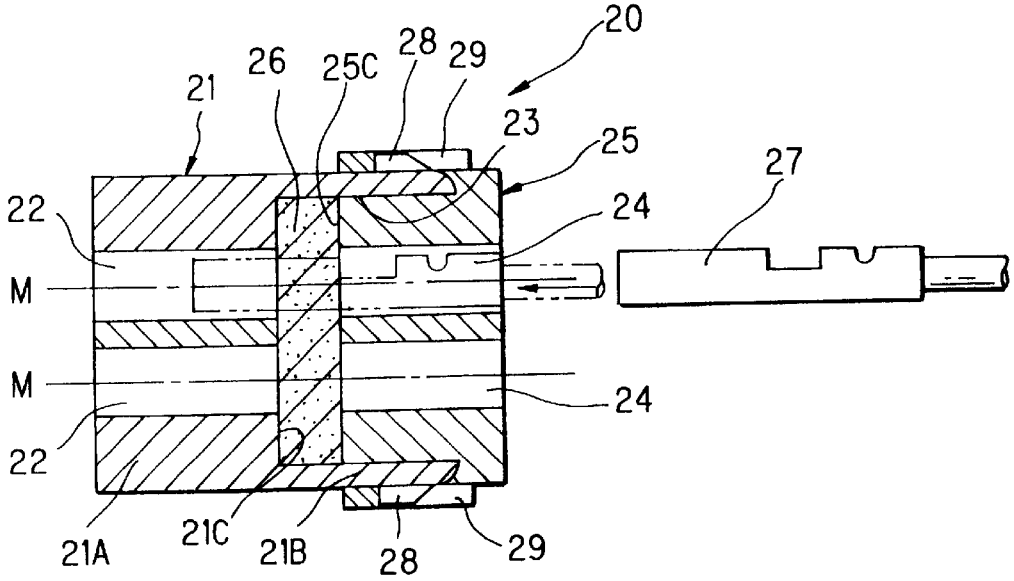
FIG. 5 is a cross-section view of a general waterproof connector.
Figure 6A:
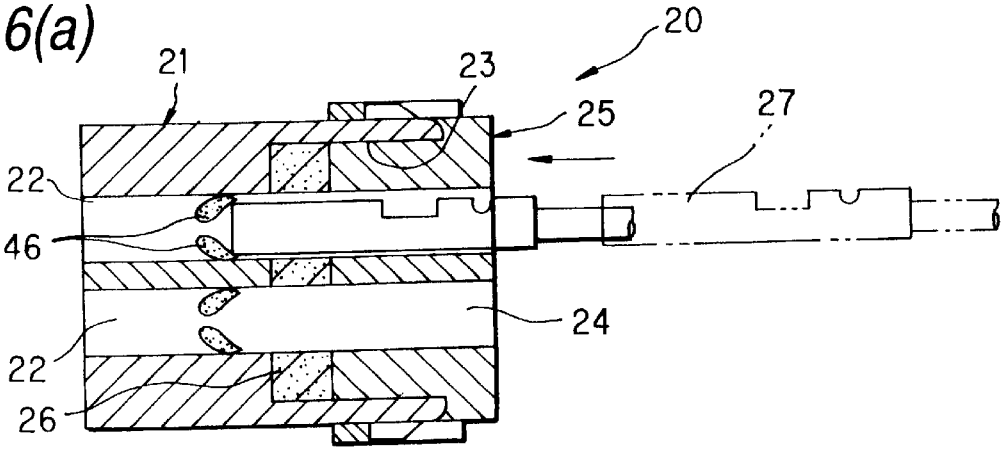
FIG. 6(*a*) and FIG. 6(*b*) are cross-sectional views of a function of a general waterproof connector.
Figure 6B:
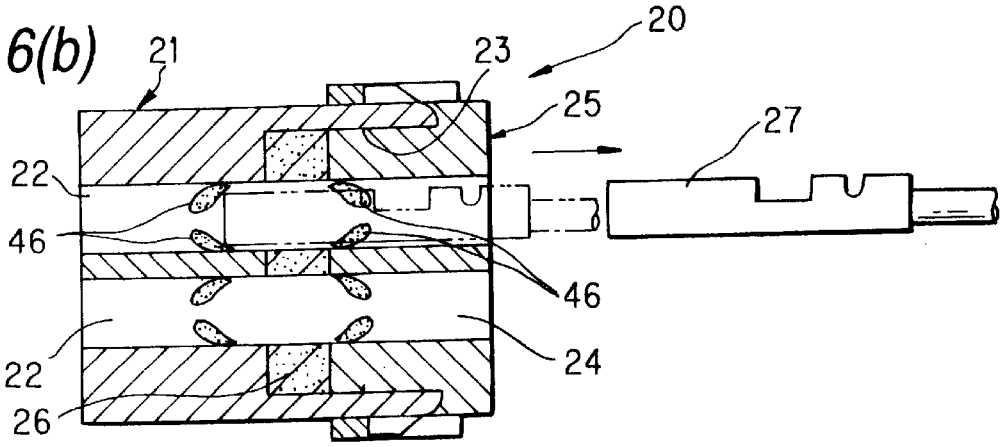

In the following description, portions which have been explained with reference to FIGS. 5 and 6 are appended by same symbols for the purpose of simplifying explanation or omitting repeated explanation.

Figure 1:
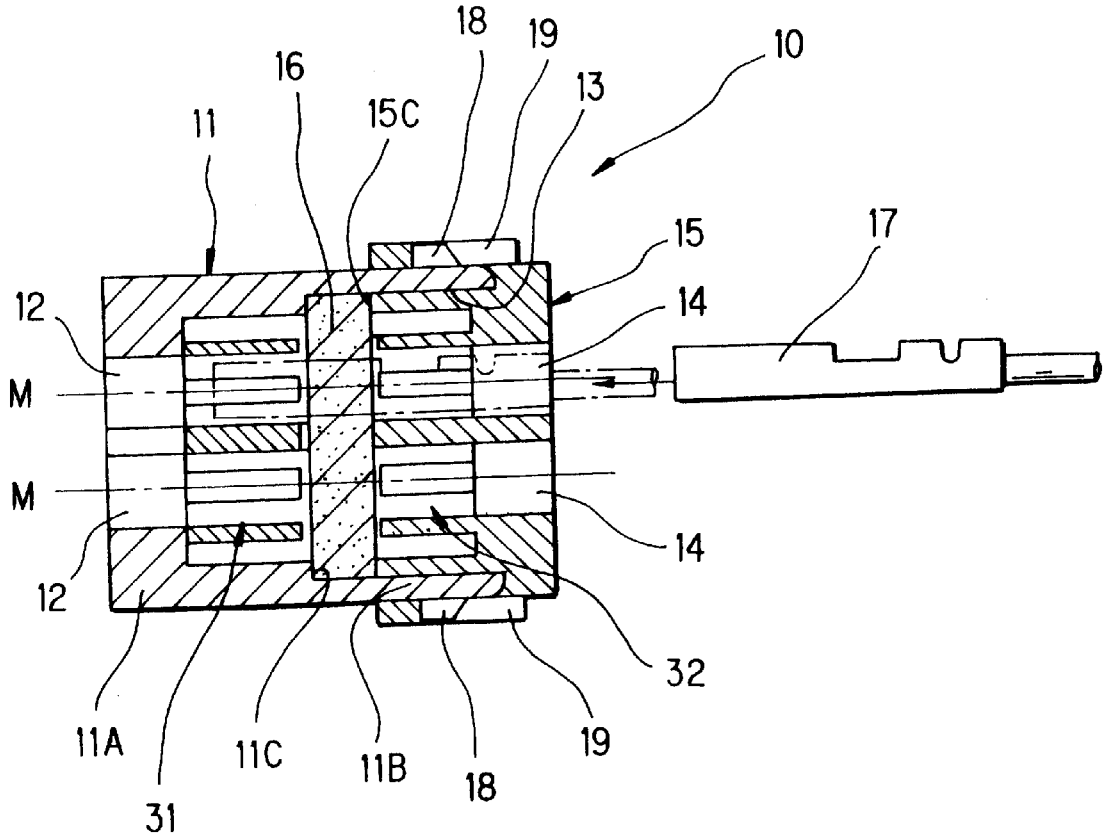
FIG. 1 is a cross-sectional view showing a preferred embodiment of a present invention.

FIG.1 shows a waterproof connector 10 which is a preferred embodiment of the present invention.

A connector housing 11 of the waterproof connector 10 is penetrated by two parallel terminal through holes 12 at one side 11A, and the connector housing 11 is provided with a gel accommodating chamber 13 accommodating a gel slab material 16 at the other side 11B.

A first gel rubbish accommodating portion 31, which accommodates gel chip rubbish 36 (shown in FIG. 3) generated in association with insertion and removal of the terminal 17, is formed at an inner wall surface 11C side of the connector housing 11.

Figure 2:
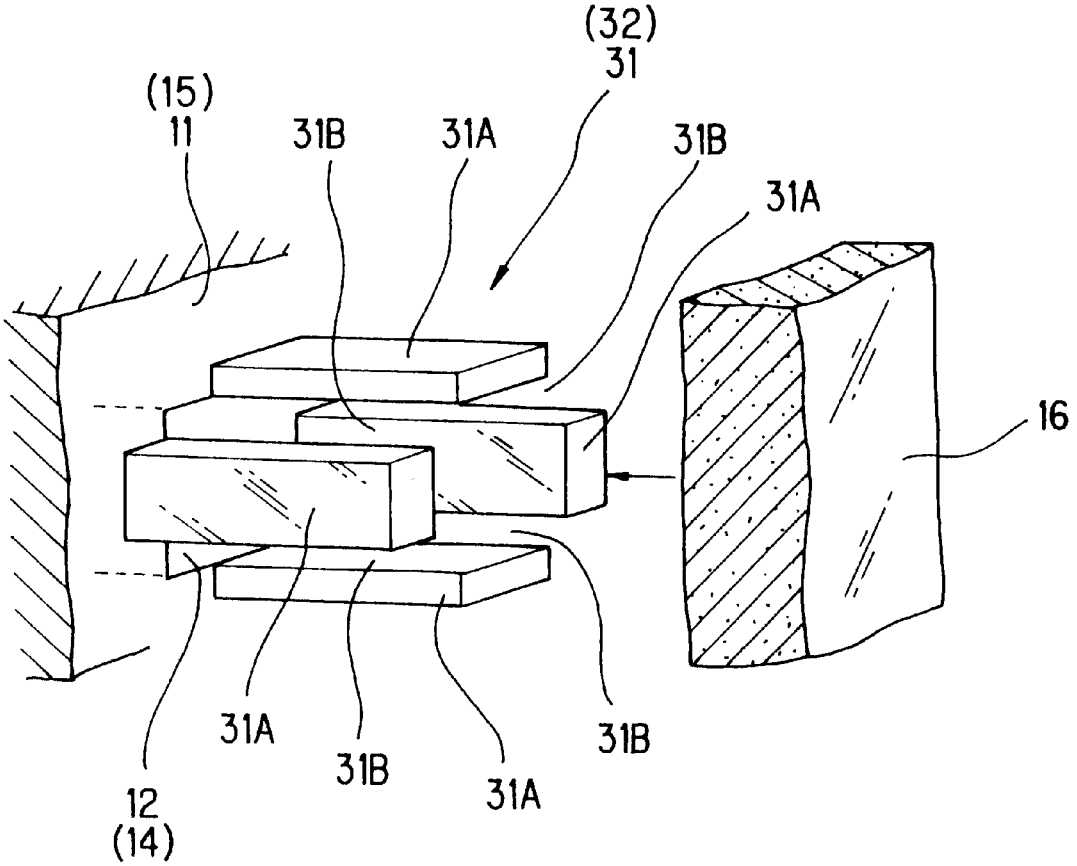
FIG. 2 is a perspective view of important portion of FIG. 1.

As shown in FIG. 2, the first gel rubbish accommodating portion 31 is provided with small pieces 31A located at respective side portions of the rectangular terminal through hole 12, thereby defining space portions 31B between adjacent two of the small pieces 31A. The small pieces 31A form a part of the terminal through hole 12 close to the inner wall surface 11C.

A sustain portion 15 is penetrated by two terminal through holes 14 which is parallel to each other and coincide with axial lines M of respective terminal through holes 12. A second gel rubbish accommodating portion 32 accommodating the generated gel chip rubbish 36 is formed at an inner wall surface 15C side of the sustain portion 15.

Similarly to the above-mentioned arrangement shown in FIG. 2, the second gel rubbish accommodating portion 32 is provided with small pieces 31A located at respective side portions of the rectangular terminal through hole 14, thereby defining space portions 31B between adjacent two of the small pieces 31A. The small pieces 31A form a part of the through hole 14 close to the inner wall surface 15C.

A gel slab material 16 for waterproof is accommodated in a gel accommodating chamber 13 by being sustained between the inner wall surface 11C of the connector housing 11 forming the first gel rubbish accommodating portion 31, and the inner wall surface 15C of the sustaining portion 15 forming the second gel rubbish accommodating portion 32.

Figure 3A:
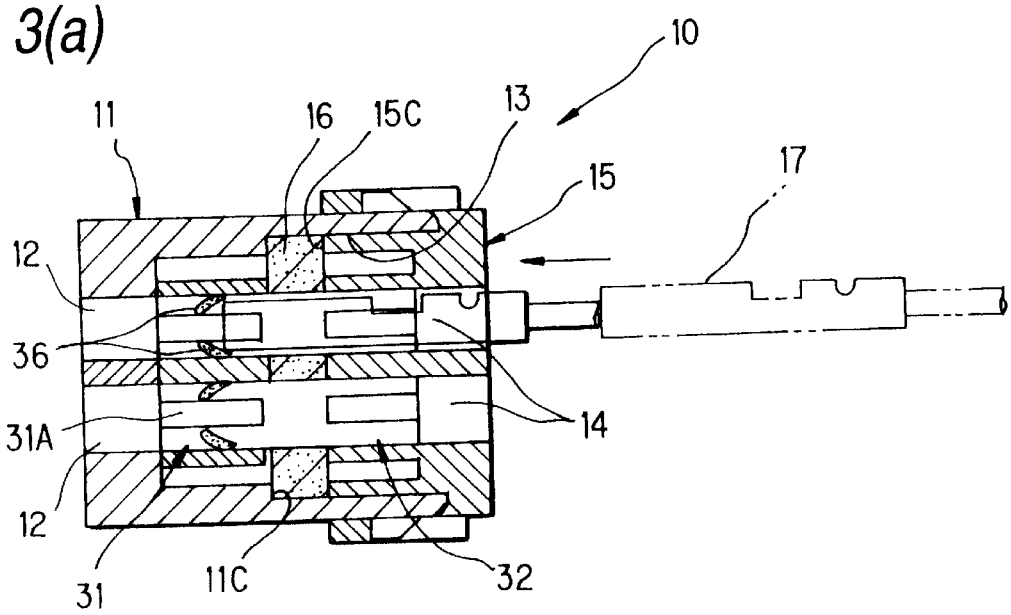
FIG. 3(*a*) and FIG. 3(*b*) are cross-sectional views showing a function of a preferred embodiment of a present invention.
Figure 3B:
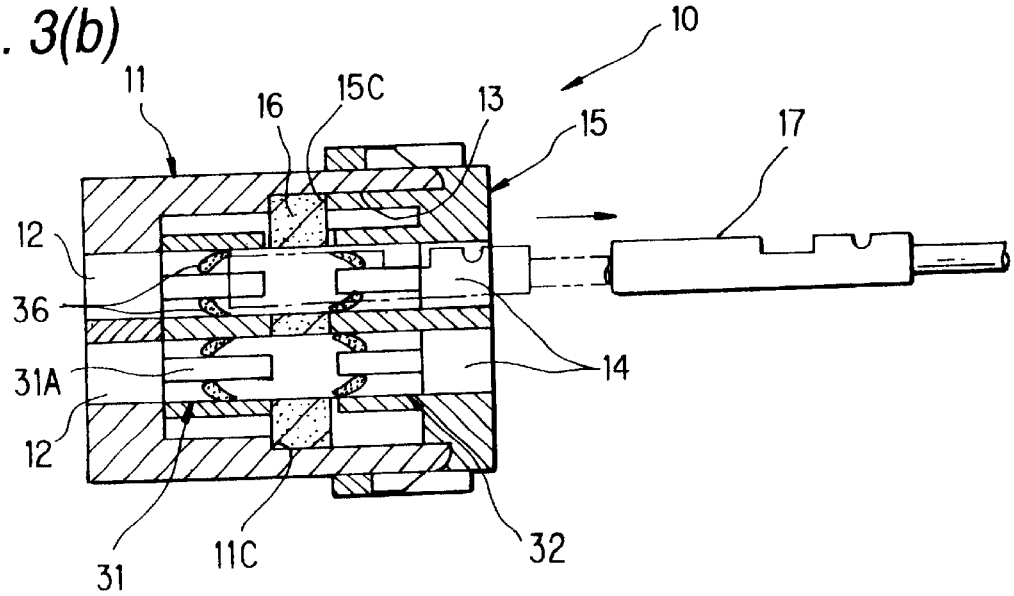

As shown in FIG. 3(*a*), the gel chip rubbish 36, which is generated when the terminal 17 break through the gel slab rubbish 16 and inserted into the terminal through hole 12,14, is accommodated in space portion 31B of the first gel rubbish accommodating portion 31 at the inner wall surface 11C side of connector housing 11.

On the other hand, as shown in FIG. 3(*b*), when the terminal 17 is pulled from the terminal through hole 12,14, the generated gel chip rubbish 36 is accommodated in the second gel rubbish accommodating portion 32 which includes a space portion 31 formed at the inner wall surface 15C side of the sustain portion 15. Therefore, the gel chip rubbish 36 getting into the terminal through hole 12,14 is prevented, and an electrically imperfect contact caused by the gel chip rubbish 36 is avoided.

Figure 4A:
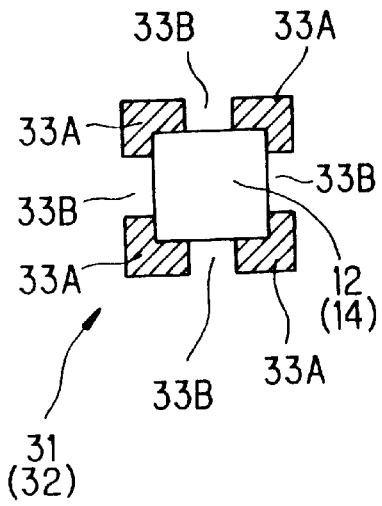
FIG. 4(*a*), FIG. 4(*b*), and FIG. 4(*c*) are cross-sectional views of a variety of embodiment of first and second gel rubbish accommodating portion.
Figure 4B:
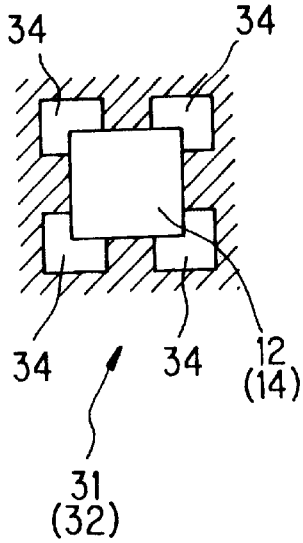
Figure 4C:
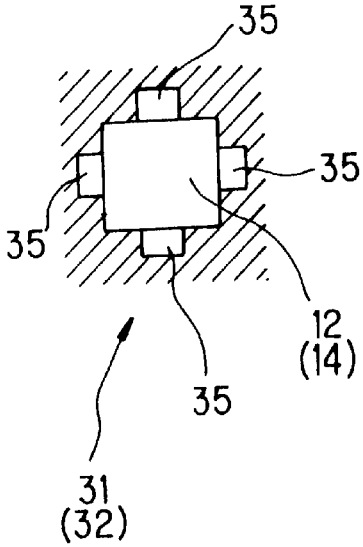

FIGS. 4(*a*) through (*c*) show varieties of embodiment of each of the first gel rubbish accommodating portion 31 and the second gel rubbish accommodating portion 32.

The first gel rubbish accommodating portion 31 and the second gel rubbish accommodating portion 32 as shown in FIG. 4(*a*) may have small pieces 33A located at respective four corner portions of the rectangular terminal through hole 12, 14, thereby defining space portions 33B between adjacent small pieces 33A. The first gel rubbish accommodating portion 31 and the second gel rubbish accommodating portion 32 as shown in FIG. 4(*b*) may have recess grooves 34 at respective four corner portions of the rectangular terminal through hole 12, 14. The first gel rubbish accommodating portion 31 and the second gel rubbish accommodating portion 32 as shown in FIG. 4(*c*) may have recess grooves 35 at respective four side portions of the rectangular terminal through hole 12,14.

In all cases of the first gel rubbish accommodating portion 31 and the second gel rubbish accommodating portion 32, as the generated gel chip rubbish 36 is accommodated into the first gel rubbish accommodating portion 31 and the second gel rubbish accommodating portion 32, it is possible to avoid electrically imperfect contact caused by the gel chip rubbish 36.

The waterproof connector of the present invention is not limited to the above-mentioned embodiment. For example, the quality of the material, the form, dimension, number, arrangement and so on of the exemplified connector housing, sustain portion, gel slab material, terminal, first gel accommodating cavity, second gel accommodating cavity, terminal through hole and gel accommodating chamber, are not limited, and may be change as far as the present invention can be realized.

Further, the waterproof connector of the present invention is not limited for use with the wiring of an automobile, and the waterproof connector of the present invention can be used in any location which requires waterproof connector.

As describing above embodiment of the present invention, when a terminal is inserted into terminal through hole, because of accommodating generated gel chip rubbish into a first gel rubbish accommodating portion, the gel chip rubbish getting into terminal through hole is prevented.

The other hand, when the terminal is pulled from terminal through hole, because of accommodating generated gel chip rubbish into a second gel rubbish accommodating portion, the gel chip rubbish getting into the terminal through hole is prevented, and an imperfect contact being caused by the gel chip rubbish getting into terminal through hole is avoided.

What is claimed is:

1. A waterproof connector comprising:

a connector housing penetrated at one side by at least one first terminal through hole, said connector housing being provided with a gel accommodating chamber;

a sustain portion penetrated by at least one second terminal through hole coaxially arranged with respect to said at least one first terminal through hole;

a gel slab material accommodated in said gel accommodating chamber and held between an inner wall surface of said connector housing and an inner wall surface of said sustain portion;

a first gel rubbish accommodating portion provided for each of said at least one first terminal though hole, located close to said inner wall surface of said connector housing, for accommodating gel chip rubbish; and a second gel rubbish accommodating portion provided for each of said at least one second terminal through hole, located close to said inner wall side of said sustain portion, for accommodating said gel chip rubbish.

2. A waterproof connector according to claim 1, wherein said first gel rubbish accommodating portion is provided with four side pieces at respective side portions of each of said at least one first terminal through hole to form four corner space portions at respective corner portions of each of said at least one first terminal through hole.

3. A waterproof connector according to claim 1, wherein said second gel rubbish accommodating portion is provided with four side pieces at respective side portions of each of said at least one second terminal through hole to form four corner space portions at respective corner portions of each of said at least one second terminal through hole.

4. A waterproof connector according to claim 1, wherein said first gel rubbish accommodating portion is provided with four corner pieces at respective corner portions of each of said at least one first terminal through hole to form four side space portions at respective side portions of each of said at least one first terminal through hole.

5. A waterproof connector according to claim 1, wherein said second gel rubbish accommodating portion is provided with four corner pieces at respective corner portions of each of said at least one second terminal through hole to form four side space portions at respective side portions of each of said at least one second terminal through hole.

6. A waterproof connector according to claim 1, wherein said first gel rubbish accommodating portion is provided with four corner recess grooves provided at respective corner portions of each of said at least one first terminal through hole.

7. A waterproof connector according to claim 1, wherein said second gel rubbish accommodating portion is provided with four corner recess grooves provided at respective corner portions of each of said at least one second terminal through hole.

8. A waterproof connector according to claim 1, wherein said first gel rubbish accommodating portion is provided with four side recess grooves provided at each side of each of said at least one first terminal through hole.

9. A waterproof connector according to claim 1, wherein said second gel rubbish accommodating portion is provided with four side recess grooves provided at each side of each of said at least one second terminal through hole.

* * * * *